United States Patent [19]

Kovaleski

[11] 3,998,403

[45] Dec. 21, 1976

[54] SUPPORTING FIXTURES FOR WIRE-CARRYING SPOOLS

[76] Inventor: Joseph J. Kovaleski, c/o Wyrepak Ind., Inc., 136 James St., Bridgeport, Conn. 06604

[22] Filed: Oct. 7, 1975

[21] Appl. No.: 620,319

[52] U.S. Cl. ..... 242/129.72

[51] Int. Cl.[2] ..... B65H 49/00

[58] Field of Search ..... 242/128, 129.5, 129.6, 242/129.62, 54 R, 129.72

[56] References Cited

UNITED STATES PATENTS

| | | | |
|---|---|---|---|
| 2,102,610 | 12/1937 | Blashill | 242/54 R |
| 2,479,826 | 8/1949 | Frick et al. | 242/128 |
| 3,202,380 | 8/1965 | Hosbein | 242/128 |
| 3,406,926 | 10/1968 | Washburn | 242/128 |
| 3,425,647 | 2/1969 | Kovaleski et al. | 242/128 |
| 3,434,677 | 3/1969 | Hannis et al. | 242/128 |

*Primary Examiner*—Leonard D. Christian
*Attorney, Agent, or Firm*—H. Gibner Lehmann; K. Gibner Lehmann

[57] ABSTRACT

A supporting fixture for tilting and holding heavy wire-carrying spools in predetermined angular positions with respect to a fixture base, such that wire can be readily payed-off the free ends of the spools. The device includes an upstanding elongate post which is pivotally secured to the base, and a clamping jaw slidably carried along the post and adapted to grip the flange of the spool being supported. The position of the jaw is adjustable to enable different sized spools to be accommodated. In one embodiment, tilting of the spool is accomplished by manually swinging the post. In another embodiment, a hydraulic cylinder is provided to shift the post and hold it in predetermined angular positions. A spindle is carried by the post, for insertion into the bore of a spool once the latter has been rolled into position on the base. The arrangement is particularly useful in tilting and supporting heavy wire-carrying spools which would otherwise be rather awkward to position and cumbersome to handle.

15 Claims, 12 Drawing Figures

SUPPORTING FIXTURES FOR WIRE-CARRYING SPOOLS

CROSS REFERENCES TO RELATED APPLICATIONS AND PATENTS

U.S. Pat. No. 3,425,647, issued Feb. 4, 1969 to Joseph J. Kovaleski and entitled "Wire Take-Off Device."

Applicant's co-pending application, U.S. Ser. No. 563,792, filed Mar. 31, 1975, and entitled "Spool Handling Dolly."

Applicant's co-pending application, U.S. Ser. No. 578,364, filed May 16, 1975 and entitled "Tension Brush with Adjustable Brake."

Applicant's co-pending application, U.S. Ser. No. 622,025 filed Oct. 14, 1975, and entitled "Quick-Connect Wire Pay-Off Cap Assembly."

Applicant's co-pending application, U.S. Ser. No. 563,787, filed Mar. 31, 1975, and entitled "Tension Brush for Wire Spool and Method for Making Same."

BACKGROUND

This invention relates generally to equipment for handling spools of wire, and more particularly to devices for facilitating the pay-off of wire from heavy wire-carrying spools.

Applicant's U.S. Pat. No. 3,425,647 shows a wire de-reeling device adapted to be used for pay-out of wire from a spool. In such a construction, the wire is drawn past the flange of a freely rotatable wheel and engages the bristles of a stationary tension brush, both the wheel and brush being secured to the spool adjacent one of its flanges.

The wheel and brush are both removable so as to not interfere with the storage or shipping of the spool. During installation of the brush and wheel, one flange of the spool must be raised and held in a tilted or free position, after which the pay-out of wire past this raised flange can commence.

In several previous installations, the spool was rested on one flange, with pay-out occurring vertically past the remaining free flange of the spool. While this solved the problem of providing a free flange on the spool, it provided to be awkward in that it involved rolling the spool into position, shifting it onto its end, and thereafter shifting it back, following dereeling. With larger spools, such an operation was difficult to accomplish manually.

In other cases, the spool was raised off the ground, and placed on special racks, with its axis maintained substantially horizontal. This was not always a satisfactory procedure, since the weight of the larger spools tended to be excessive. Such operations usually involved bulky structures and powerful motors or drive mechanisms to effect the necessary lifting.

SUMMARY

The above drawbacks and disadvantages of prior wire dereeling equipment are obviated by the present invention which has for an object the provision of a novel and improved supporting fixture for tilting and holding wire-carrying spools in predetermined angular positions, the device being simple in construction, reliable in operation, and readily adaptable for use with spools having different dimensions. A related object is the provision of a spool supporting fixture as above characterized which effects a tilting of the spool with respect to the horizontal, to thus elevate one flange off the ground, and enable pay-out of wire past the elevated flange to be readily carried out.

The above objects are accomplished by a unique supporting fixture for holding a wire-carrying spool in predetermined angular positions, comprising a stand including a fixed base and an upstanding post pivotally secured to the base, cooperable means on the stand for gripping the spool at one end and for enabling the other end to remain free and unattached, and means carried by the post enabling it to be pivotally swung with respect to the base so as to tilt the spool through an angle wherein its axis is inclined to the horizontal. The cooperable means includes a clamping jaw which engages the flange of the spool to be mounted and which is slidably carried by the post. The arrangement is such that a spool can be rolled into position on the base, one flange of the spool clamped in the jaw so as to be retained thereby, and the spool then tilted in order to elevate the other flange from the base, and held in a stationary position to enable pay-out of wire past the free end. As a result, the lifting of heavy spools is virtually eliminated.

Features of the invention include the provision of an improved tilt stand for heavy, wire-filled spools, which is especially simple and sturdy in its construction, easily operated, and reliable in operation throughout an extended useful life.

Other features and advantages will hereinafter appear.

In the drawings, illustrating several embodiments of the invention:

Figure 1:
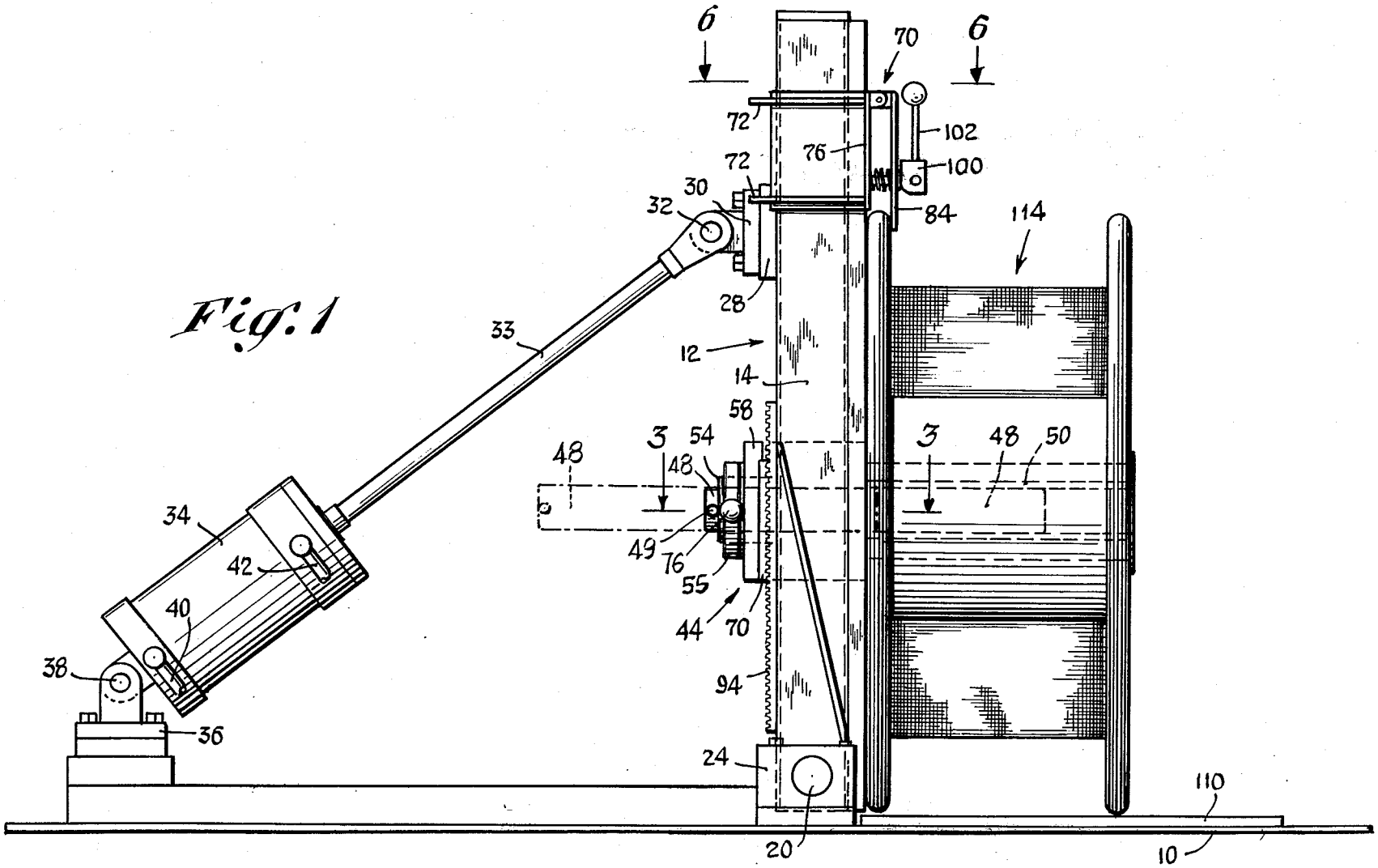
FIG. 1 is a side elevational view of a tilting and support fixture for wire-carrying spools, constructed in accordance with the present invention.
Figure 2:
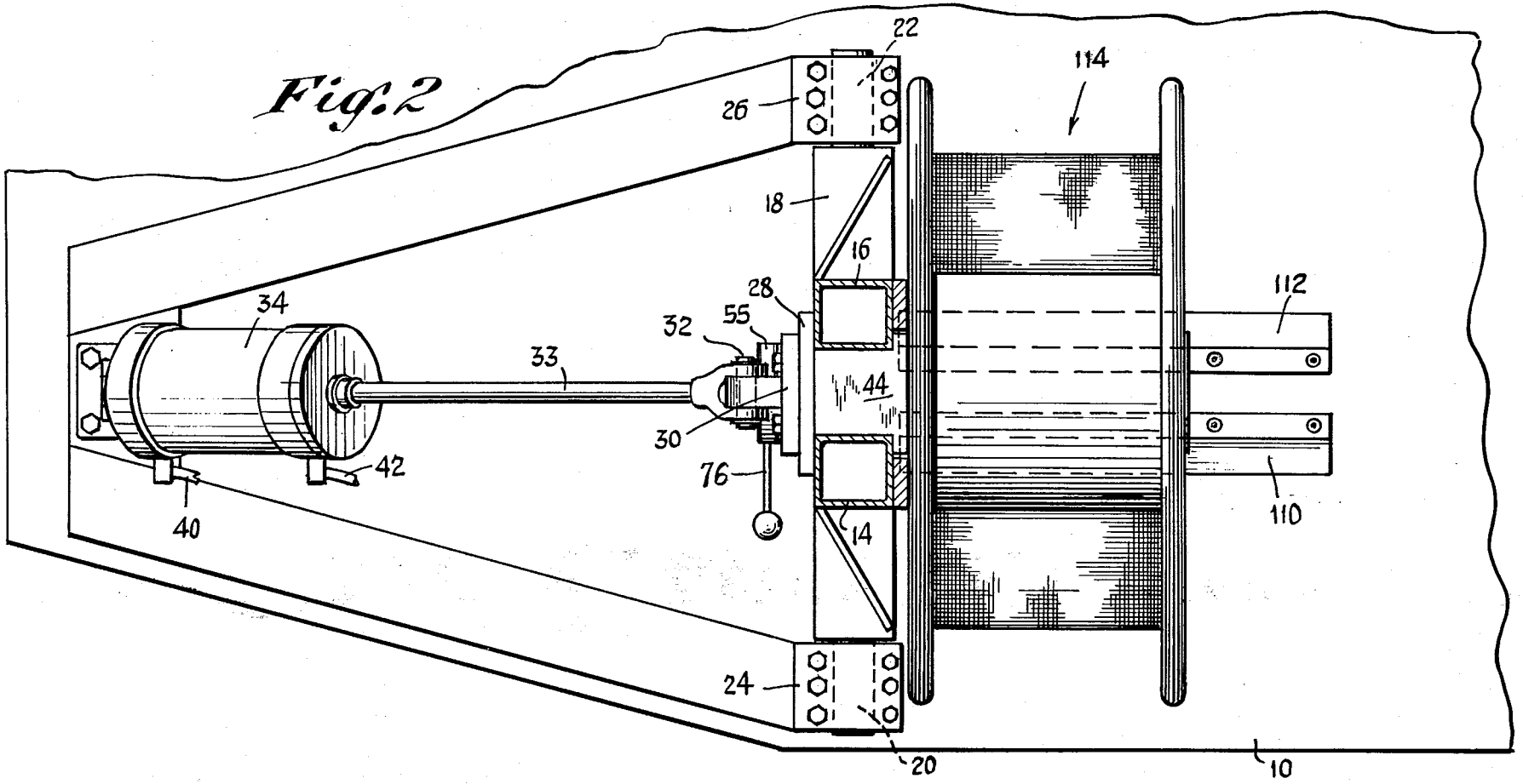
FIG. 2 is a top plan view of the supporting fixture of FIG. 1.

Referring to FIGS. 1 and 2 and in accordance with the present invention there is illustrated a novel supporting fixture for holding wire-carrying spools in predetermined angular positions, the fixture comprising a base 10 and an upright, elongate post 12 constituted as a pair of box-section members 14, 16. The latter are welded to a transverse connector bar 18 having oppositely extending shafts 20, 22 which are received respectively in bearings 24, 26 carried by the base. As shown in FIG. 2 the free ends of the members 14, 16 are connected by a cross bar 28 having a pivot fitting 30 and pivot pin 32. A link 33 extends from the fitting to a hydraulic cylinder 34, which in turn is connected to another pivot fitting 36 through a pivot pin 38. The fitting 36 is carried by the base 10. The hydraulic cylinder is controlled through ports 40, 42 connected to suitable control valves (not shown).

Referring now to FIGS. 1 and 3–5, there is illustrated a spindle support block 44 which is slidably carried between the upright members 14, 16.

Figure 3:
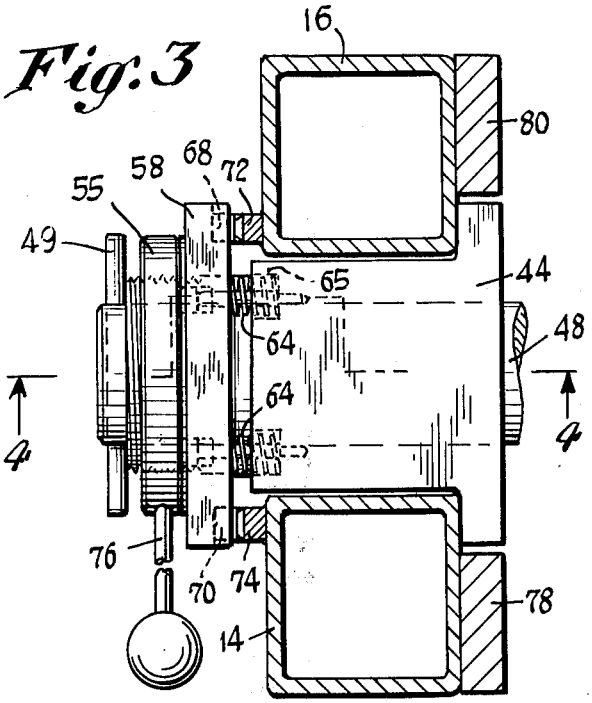
FIG. 3 is a fragmentary horizontal section taken on line 3—3 of FIG. 1.
Figure 6:
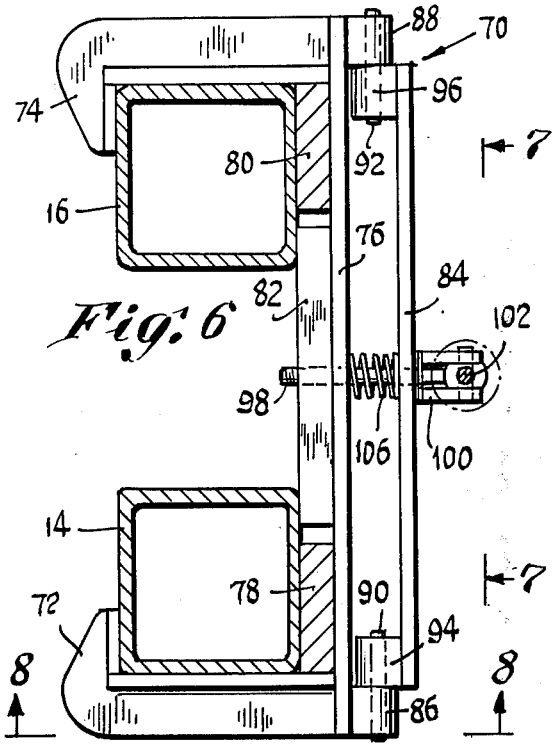
FIG. 6 is a horizontal section taken on line 6—6 of FIG. 1.
Figure 4:
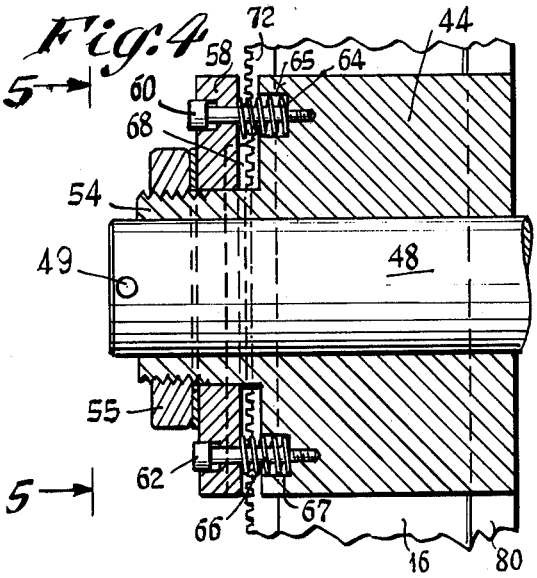
FIG. 4 is a vertical section taken on line 4—4 of FIG. 3.
Figure 5:
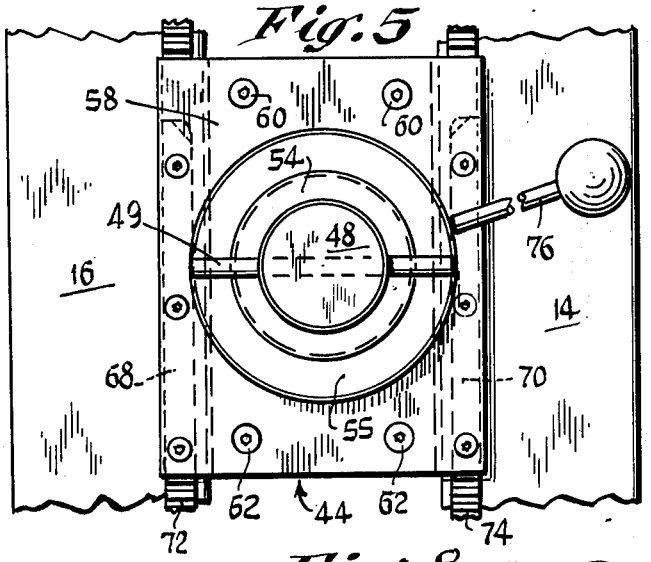
FIG. 5 is a view taken on line 5—5 of FIG. 4.
Figure 7:
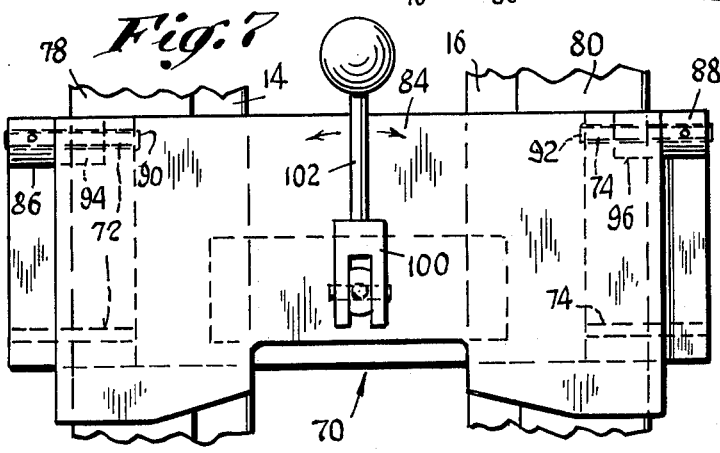
FIG. 7 is a view taken on line 7—7 of FIG. 6.
Figure 8:
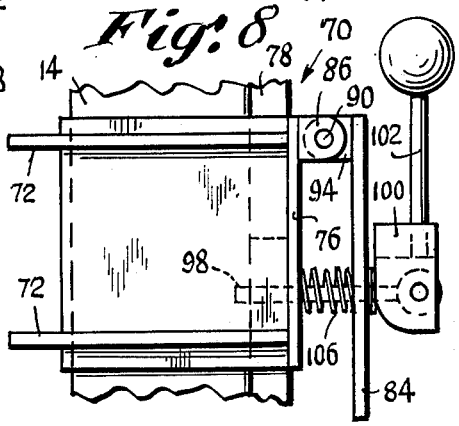
FIG. 8 is a view taken on line 8—8 of FIG. 6.

The spindle support block 44 has a hollow bore 46 which loosely receives a spindle 48 adapted to be inserted into the bore of the spool being supported. The spindle can include one or more telescoping adaptor sleeves 50, to accommodate spools of different sizes. The support block further includes a tubular projection 54 which is externally threaded and carries a nut 55. A locking plate 58 is also carried on the projection and held in place by screws 60, 62. Springs 64, 66 received in recesses 65, 67 respectively, normally bias the locking plate in a direction away from the body of the spindle support block 44. The plate includes two racks 68, 70 which are engageable with cooperable racks 72, 74 respectively which are welded to the box section uprights 14, 16 as shown in FIG. 3. A handle 76 is secured to the nut 55 to enable the latter to be tightened. The arrangement maintains the spindle support block 44 in a predetermined position with respect to the uprights 14, 16. The position of the support block 44 can be changed by loosening the nut 55, during which the springs 64, 66 bias the locking plate 58 toward the left in FIG. 4, such that the racks 68, 72 and 70, 74 are out of engagement. This enables the position of the block 44 to be re-adjusted, such that the spindle 48 will be at the same location as the bore of the spool being supported, when the latter is rolled into position on the base as illustrated in FIG. 1.

Figure 9:
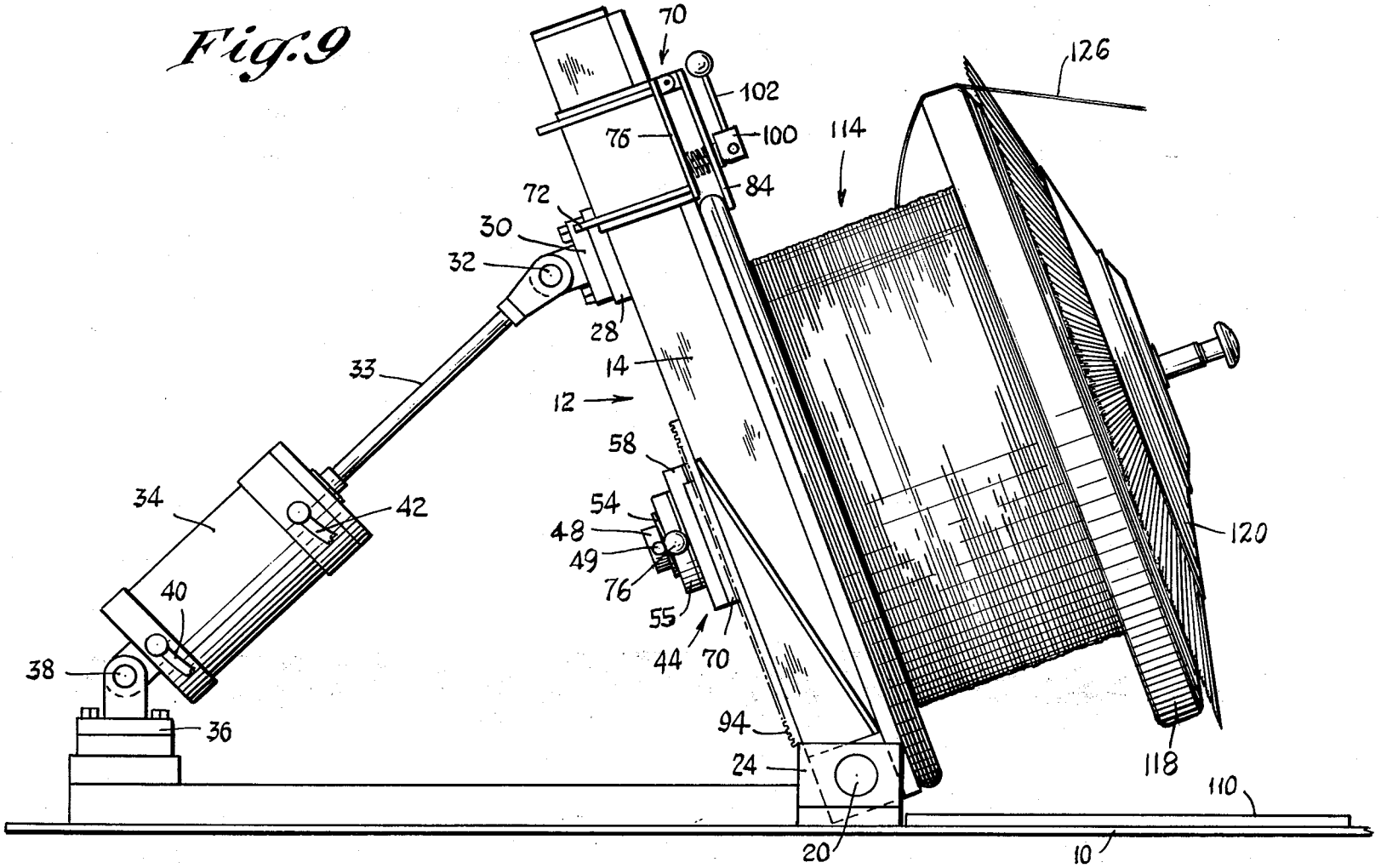
FIG. 9 is a view like FIG. 1, except showing the support fixture disposed in a tilted position, and showing a spool on which there has been installed a pay-off cap assembly for minimizing excessive looseness of wire being de-reeled from the spool.

Referring now to FIGS. 1 and 6–8, there is slidably carried on the uprights 14, 16 a carriage 70 including jaw 72, 74 and a carrier 76 connecting the two. As illustrated particularly in FIG. 6, the uprights 14, 16 have welded tracks 78, 80 extending for substantially their entire lengths. The carrier 76 has a slider bar 82 which rides between the tracks 78, 80 as the carriage 70 moves along the uprights 14, 16. Pivotally connected to the carrier 76 is a clamping jaw 84. The carrier includes blocks 86, 88 which secure shafts 90, 92; the latter in turn carry bearing blocks 94, 96 respectively welded to the clamping jaw 84. The slide bar 82 includes a threaded hole which receives a screw 98 constituting a draw bolt. Pivotally carried by the screw is a cam 100 having an operating handle 102. A spring 106 is disposed between the carrier 76 and the clamping jaw 84, biasing the latter into engagement with the cam 100. It can be readily seen that by proper operation of the handle 102, the operator can operate the cam 100 and also advance the screw 98 with respect to the jaw carrier 76. The free end of the clamping jaw 84 is adapted to engage the rim of the spool being supported, as shown in FIG. 1. The jaw 84 is illustrated in its flange locking position in FIGS. 1, 8 and 9. Swinging the arm 102 clockwise will enable the jaw to be biased (by the spring 106) in a direction away from the carrier 76, to a position wherein it is disengaged from the spool flange. This is referred to as the flange releasing position.

As particularly illustrated in FIG. 2, there is carried on the base a pair of positioning ramps 110, 112. In operation, a wire carrying spool 114 can be rolled into the position of FIG. 1 wherein both flanges rest atop the groove formed between the ramps 110, 112. This is done with the spindle 48 withdrawn partially so as not to interfere with the placement of the spool. FIG. 1 shows the spindle in such a partially withdrawn position, in dotted lines. Next, the location of the spindle support block 44 is adjusted with respect to the uprights 14, 16 such that the axis of the spindle coincides with the axis of the spool, after which the spindle is advanced (to the right in FIG. 1) into the spool bore. A stop pin 49 on the spindle limits the insertion of the latter to a predetermined position, so that the spindle will always be accessible from the side of the support block adjacent the projection 54. The carriage 70 is then positioned vertically on the uprights 14, 16 such that the free end of the clamping jaw 84 engages the rim of the one spool flange as shown in FIG. 1. The clamp is then tightened by operation of the cam 100 (including rotation of the draw bolt 98 if required, to adjust the position of the cam). With the clamping jaw tightened, the hydraulic cylinder is operated to effect counterclockwise shifting of the uprights 14, 16 in FIG. 1, thus effecting tilting of the axis of the spool. The spool flange which is remote from the uprights is thus free to receive a take-off mechanism in the form of a snap on assembly, comprising a freely rotatable wheel 118 and tension brush 120 as described and illustrated in my co-pending applications, U.S. Ser. Nos. 563,787 and 578,364. Further details of this assembly will not be given here, since they are adequately described in these cases.

During pay-off, the strand of wire 126 from the spool brushes by the wheel 118 and bristles of the brush 120, and passes through a wire guide (not shown) to suitable take-up spools (not shown), coil winding equipment (not shown), or the like. When the desired amount of wire has been removed, the wheel 118 and brush can be removed, and the hydraulic cylinder operated to tilt the spool axis to the horizontal position of FIG. 1, after which the spindle 48 is withdrawn from the support block 44 and the spool rolled away. The above arrangement has the advantage that lifting of spools by the operator is completely eliminated. In addition, since the spool is tilted by the fixture rather than being completely lifted, the size of the support equipment can be physically smaller and lighter in weight. The fixture is capable of imparting a 30° tilt to the spool, which has been found to be a convenient figure for most de-reeling applications.

Figure 10:
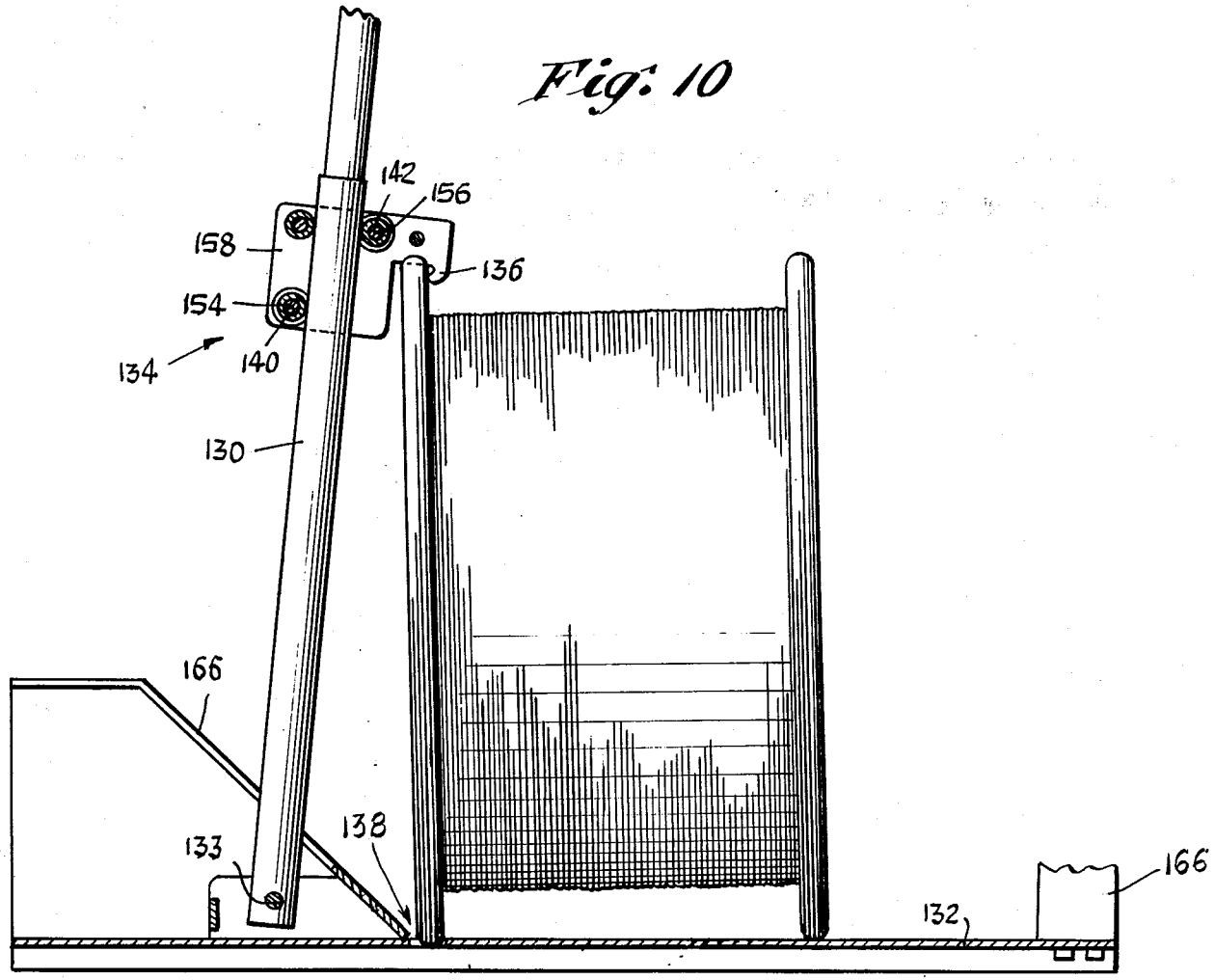
FIG. 10 is a side view, partly in elevation and partly in section of a modified spool support fixture, constituting another embodiment of the invention.
Figures 11, 12:
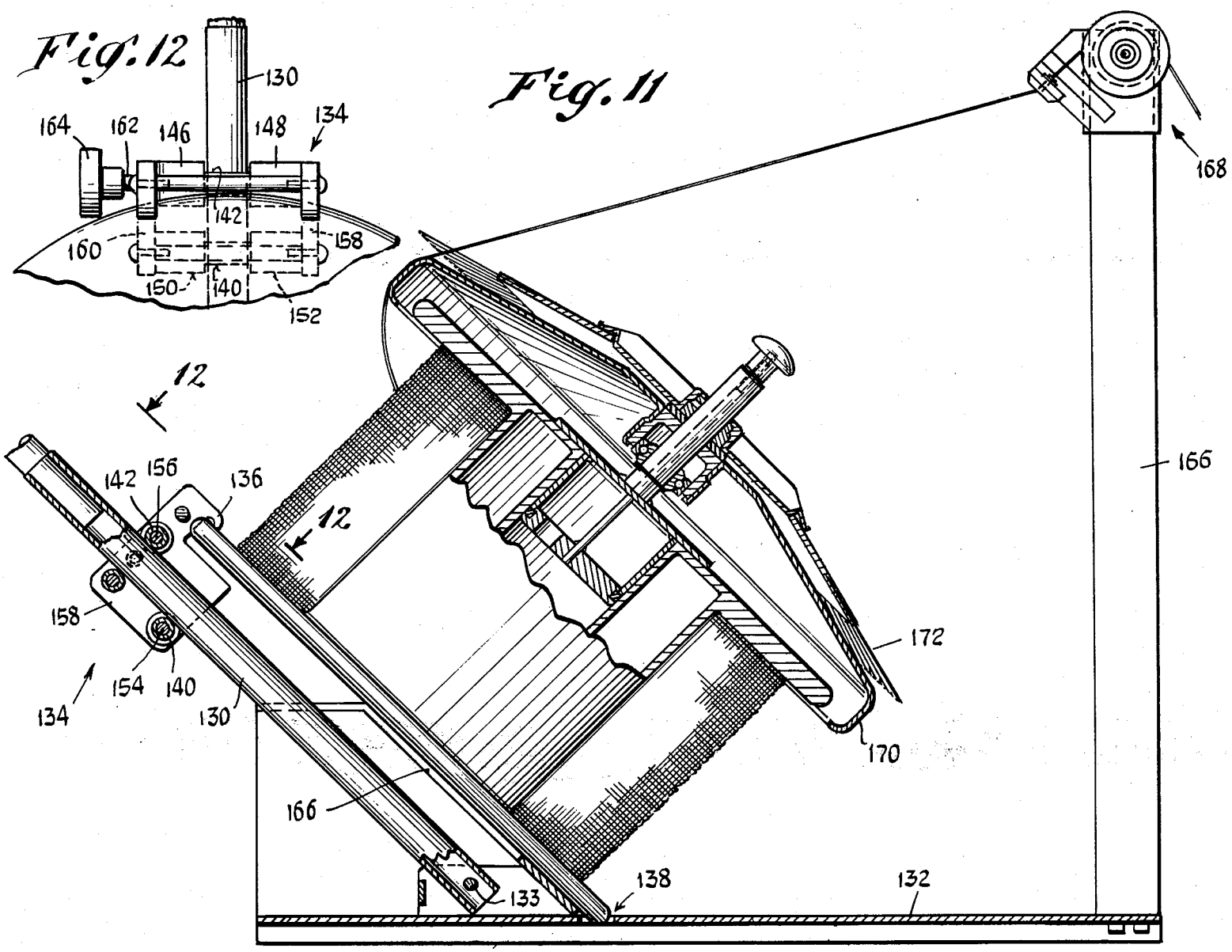
FIG. 11 is a view like FIG. 10 except showing the modified spool support fixture disposed in a tilted position, and showing a spool on which there has been installed a pay-off cap assembly for minimizing excessive looseness of wire being de-reeled from the spool.
FIG. 12 is a view taken on line 12—12 of FIG. 11.

Another embodiment of the invention is shown in FIGS. 10–12, illustrating a support fixture for tilting or holding a wire carrying spool and de-reeling assembly similar to that of the first embodiment. The fixture includes an upstanding tubular elongate support 130 pivotally connected to the base 132 of the fixture by means of a pivot pin 133, the support carrying a slidable clamp 134 having a hook portion 136 adapted to engage the rim portion of one flange of the spool. An aperture 138 in the base provides a shoulder or seat for the one flange of the spool, at a point on its rim diametrically opposite the location of the clamp 134. As shown in FIGS. 10–12, the latter includes rollers 140, 142 which engage the opposite sides of the tubular support 130, and centralizing members 146, 148 and 150, 152 which engage the support along oppositely disposed edges to minimize the lateral shifting of the clamp with respect thereto.

The rollers 140, 142 are carried on stationary support shafts 154, 156 which extend between two parallel plates 158, 160 constituting the frame of the clamp 134. The plate 160 has a threaded hole which receives a locking screw 162 carrying a knob 164. Tightening the screw 162 against the tubular member 130 prevents relative movement between the latter and the clamp 134, and thus retains the spool in a tilted position as shown in FIG. 11.

Also provided on the base 132 is a stop member 166 which operates to support the spool in a predetermined tilted position, as shown in FIG. 11. Under such circumstances, the center of gravity of the spool is disposed to the left of the shoulder 138 and the spool can merely rest on the stop 166 without reliance being placed on the locking screw being tightened against the tubular support 130.

Disposed on the base 132 is an upstanding post 166 carrying a wire guide 168. The latter maintains tension in the strand as it is being de-reeled. A wire take-off cap assembly comprising a rotatable wheel 170 and tension brush 172 minimizes excessive looseness and kinking of the wire, as in the previous embodiment.

FIG. 10 shows a spool in position on the base 132, wherein one flange of the spool is engaging the shoulder 138, with the cap assembly shown removed. With the clamp 134 in the position shown, the operator swings the support 130 counterclockwise in FIG. 10, to effect tilting of the spool. As this is done, the clamp 134 slides down the support an extent in order to maintain contact with the flange. After arriving at the tilted position of FIG. 11, the spool receives the cap assembly, after which payout of wire can commence.

From the above it can be seen that I have provided novel tilting and supporting fixtures for wire carrying spools, the devices being simple in construction and reliable in operation. Both the manually and power operated units are especially useful for handling larger spools which cannot readily be lifted without the use of special equipment. The device is thus seen to represent a distinct advance in the technology of wire spooling equipment.

Variations and modifications are possible without departing from the spirit of the invention.

I claim:

1. A tilt mounting device for holding wire-filled spools in a tilted position with their axes located angularly with respect to the horizontal, comprising in combination:

a. an articulated stand comprising a generally flat base adapted to rest on a supporting surface and an upstanding post pivotally secured to the base, b. said base being arranged to enable a wire-filled spool to be rolled on it with one end of the spool adjacent said post, c. cooperable means on said stand, including a clamping jaw engageable with a flange of the spool to be mounted, said jaw being slidably carried by said post, for gripping the spool at one end thereof, said means enabling the other end of the spool to remain free and unattached, and d. means carried by the post, enabling the latter and the gripped spool to be pivotally swung with respect to the base so as to tilt the spool through an angle where the axis of the spool is inclined to the horizontal.

2. The invention as defined in claim 1, and further including:

a. powered means for swinging said post with respect to the base, and for holding it stationary in predetermined fixed positions, b. said cooperable means comprising a spindle adapted to engage the bore of a spool being supported, and c. adjustable means for mounting the spindle at various positions along the length of the upstanding post, d. the distance between the clamping jaw and the axis of the spindle being adjustable whereby the stand can be employed with different spools of varying dimensions.

3. The invention as set forth in claim 2, wherein:

a. said upstanding post comprises a track, b. said cooperable means comprising a carriage movable along said track, said carriage carrying said clamping jaw, the latter being movable between a flange releasing and a flange locking position, and c. a cam operator disposed on said carriage and engageable with the clamping jaw for selectively moving the latter between its flange releasing and locking positions.

4. The invention as set forth in claim 3, and further including:

a. means adjustably mounting the cam operator on the carriage for retaining the clamping jaw in different locked positions, thereby accommodating spools having flanges of different thicknesses.

5. The invention as set forth in claim 4, wherein:

a. said adjustable mounting means includes a screw pivotally carrying said cam operator, b. said carriage having a threaded aperture to receive said screw, and c. a spring disposed between the carriage and clamping jaw, biasing the latter into engagement with the cam operator, d. turning of said cam operator about the axis of the screw effecting adjustment of the locked position of the clamping jaw.

6. The invention as set forth in claim 5, and further including:

a. a handle secured to the cam operator for effecting manual operation thereof.

7. The invention as set forth in claim 3, wherein:

a. said track comprises a pair of coextensive box sections in substantially parallel, spaced relation, b. a pair of retainer hooks disposed on said carriage and respectively engaging said box sections to thereby hold captive the carriage while enabling its sliding movement along said sections.

8. The invention as set forth in claim 7, wherein:

a. movement of the cam operator to a locked position urges the carriage sideways with respect to the box sections, thereby increasing the pressure exerted thereon by said retainer hooks, the latter tending to hold the carriage in a fixed position.

9. The invention as set forth in claim 2, wherein:

a. said adjustable means comprises a spindle support block having a through bore slidably receiving the spindle, and b. cooperable means on the upright post and the spindle support block for locking the latter in predetermined fixed positions on the post.

10. The invention as set forth in claim 9, wherein:

a. said cooperable means comprises a rack disposed along said post and an additional rack carried by the support block and adapted to engage the first rack at different locations, during positioning of the support block.

11. The invention as set forth in claim 10, and further including:

a. a spring means normally biasing the racks out of engagement with one another, to enable free positioning of the spindle support block on the upstanding post, b. screw means carried by the block, c. a threaded collar carried by the screw means and acting against the spring means to effect engagement of the racks and locking of the support block in a fixed position.

12. The invention as defined in claim 1, wherein:

a. said base includes means defining a shoulder adapted to be engaged by the rim portion of the flange at said one spool end, b. said clamping jaw having a hook portion adapted to engage the rim of said flange at a point removed from its point of engagement with said shoulder, c. said shoulder constituting a pivot about which tilting of the spool occurs.

13. The invention as set forth in claim 12, wherein:

a. said jaw includes a threaded locking member engageable with the post for holding the jaw in various fixed positions.

14. The invention as set forth in claim 12, and further including:

a. a stop carried by the base and engageable with one end of the spool when the latter is tilted, for supporting it in said tilted position.

15. The invention as set forth in claim 12, and further including:

a. an upstanding wire guide carried by the base for receiving wire payed out past the free end of the spool when the latter is in its tilted position.

* * * * *